US005706017A

United States Patent [19]

Büttgenbach

[11] Patent Number: 5,706,017

[45] Date of Patent: Jan. 6, 1998

[54] HYBRID ANTENNA INCLUDING A DIELECTRIC LENS AND PLANAR FEED

[75] Inventor: Thomas H. Büttgenbach, Pasadena, Calif.

[73] Assignee: California Institute of Technology, Pasadena, Calif.

[21] Appl. No.: 49,310

[22] Filed: Apr. 21, 1993

[51] Int. Cl.[6] ..... H01Q 19/06

[52] U.S. Cl. ..... 343/753; 343/755; 343/781 P; 343/895

[58] Field of Search ..... 343/753, 755, 343/720, 725, 846, 895, 911 R, 911 L, 781 P, 781 CA; H01Q 15/08, 19/06

[56] References Cited

U.S. PATENT DOCUMENTS

| | | | |
|---|---|---|---|
| 3,833,906 | 9/1974 | Augustine | 343/753 |
| 4,368,472 | 1/1983 | Gandhi | 343/895 |
| 4,387,379 | 6/1983 | Hardie | 343/895 |
| 4,755,820 | 7/1988 | Backhouse et al. | 343/753 |
| 4,809,011 | 2/1989 | Kunz | 343/754 |
| 5,162,806 | 11/1992 | Monser | 343/895 |
| 5,166,698 | 11/1992 | Ashbaugh et al. | 343/786 |

*Primary Examiner*—Donald T. Hajec
*Assistant Examiner*—Tan Ho
*Attorney, Agent, or Firm*—Fish & Richardson P.C.

[57] ABSTRACT

A hybrid antenna including a dielectric lens-antenna in the shape of an extended hemispherical dielectric lens than is operated in the diffraction limited regime. The dielectric lens-antenna is fed by a planar-structure antenna. The planar antenna is mounted on the flat side of the dielectric lens-antenna, using it as a substrate. An optimum extension distance is found experimentally and numerically for which excellent beam patterns and simultaneously high aperture efficiencies can be achieved. The hybrid antenna is diffraction limited, space efficient in an array due to its high aperture efficiency, and is easily mass produced, thus being well suited for focal place receiver arrays.

10 Claims, 6 Drawing Sheets

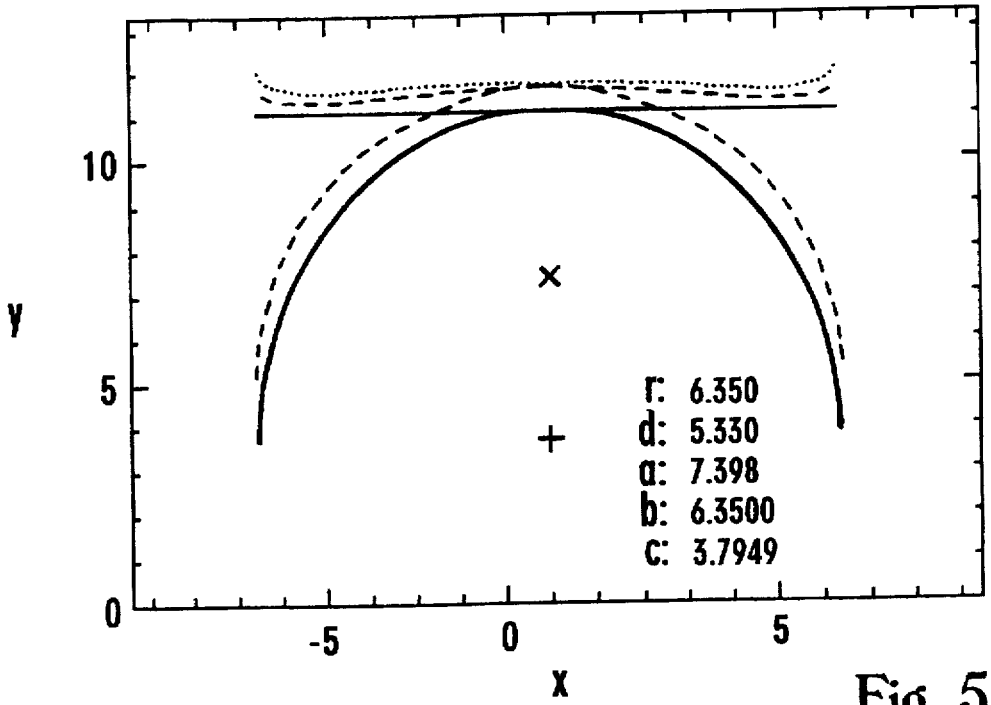
Fig. 5
Fig. 6
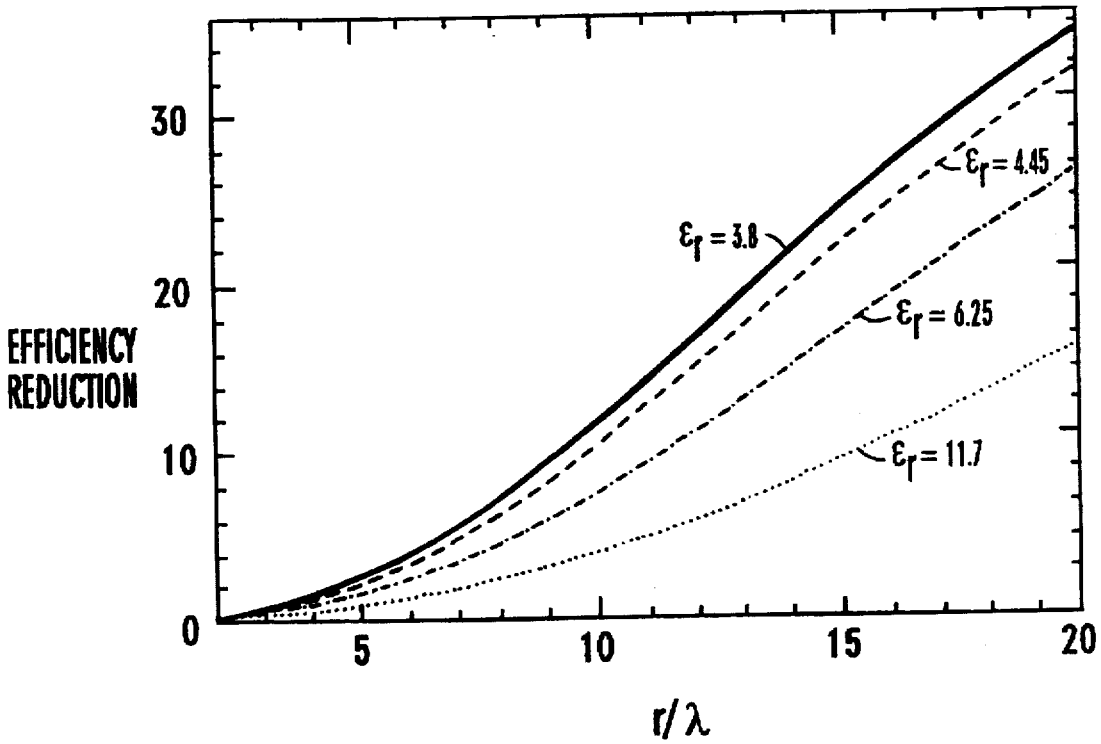

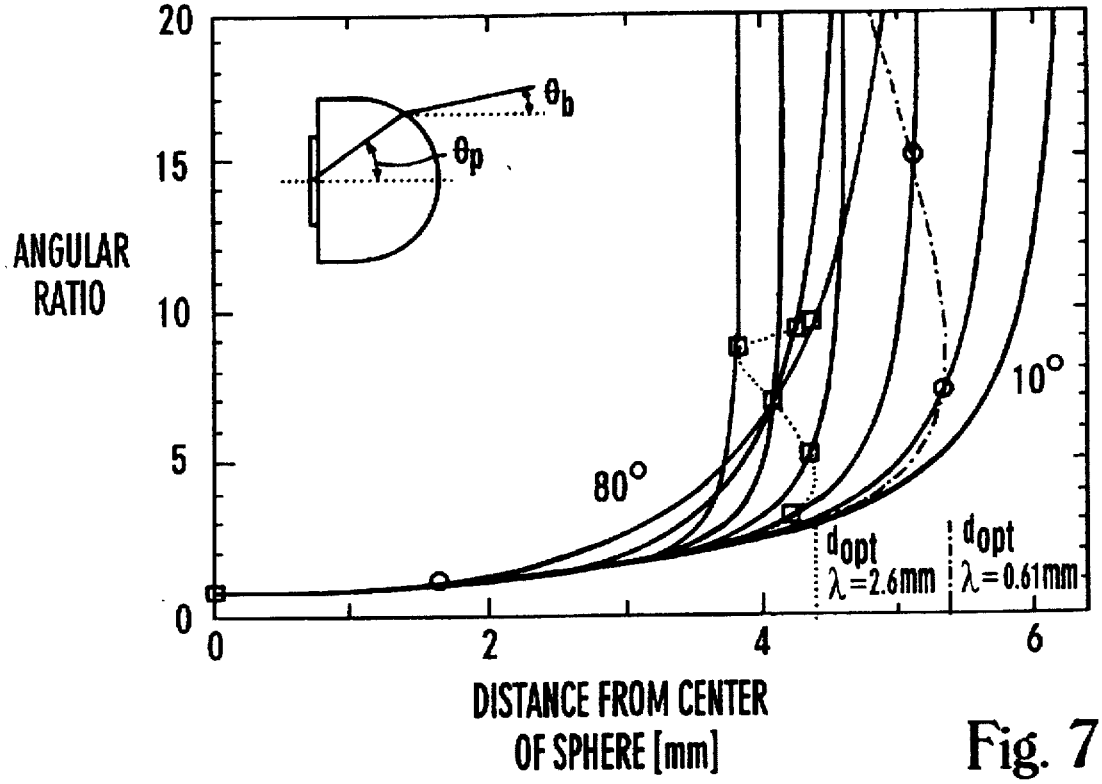
Fig. 7
Fig. 8
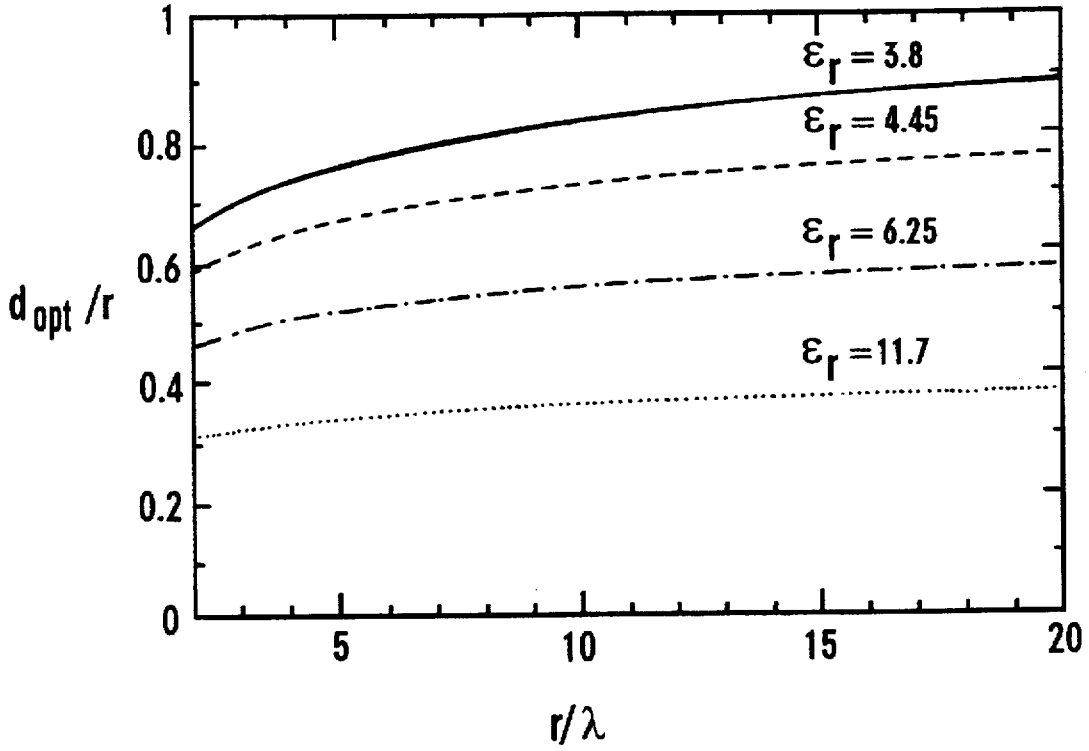

HYBRID ANTENNA INCLUDING A DIELECTRIC LENS AND PLANAR FEED

ORIGIN OF INVENTION

The U.S. Government has rights to this invention pursuant to Grant No. AST90-15755, awarded by National Science Foundation.

FIELD OF THE INVENTION

The present invention relates to a hybrid antenna which includes a hemispherical dielectric lens and a planar antenna.

BACKGROUND AND SUMMARY OF THE INVENTION

Remote sensing in the millimeter and submillimeter wavelength bands requires sensitive detectors and antennas with well-defined beam properties used to collect the radiation. The present invention relates to an antenna system that provides such a well defined beam pattern. A specific application of remote sensing in the millimeter and submillimeter wavelength bands—heterodyne spectroscopy in radio astronomy—will be emphasized since the instrumentation developed was primarily aimed at that application. Of course, the same basic principles apply to most other applications for detection of radiation and the present invention should be construed to cover those other predictable areas.

The basic radio astronomy system is shown in FIG. 1. Radio astronomy uses a large aperture antenna 100 with a subreflector 101 to focus the incoming radiation onto a second, much smaller antenna 102 herein the receiver antenna, which feeds the received power to a detector 104, either directly or via an impedance matching circuit. Sometimes an additional lens 103 is needed to match the beam from the telescope to that of the receiver antenna. The properties of the receiver antenna 102, and its coupling to the primary antenna, i.e., the radio telescope, will be discussed.

Traditionally, the receiver antennas used are waveguide horn antennas that transform the free space TEM mode coming from the telescope into a waveguide mode where the radiation is detected in a non-linear element suspended across the waveguide. However, in the submillimeter band these waveguide structures become expensive and difficult to manufacture due to their small size. Since the skin depth gets smaller at shorter wavelengths the surface roughness of the walls of the waveguide structures becomes increasingly more important and thus losses will increase. Waveguide horn antennas with their associated metal waveguide structures are also not well suited for array applications since they are traditionally manufactured by machining the individual waveguide components.

An alternate approach to waveguide techniques is to use quasi-optical coupling, where the waveguide horn antenna is replaced by a planar antenna on a thick dielectric substrate that supports the antenna. Broadside polar antennas such as the bow-tie antenna the logarithmic periodic or the logarithmic spiral antenna are essentially frequency independent, but have very broad radiation patterns (typically $f/0.5$, see equation (2) for definition of $f$-number). The dielectric substrate is shaped to be a hyperhemispherical lens to reduce the beam pattern's width by n, where n is the refractive index. This can yield $f/1$ to $f/2$, depending on the dielectric used. The hyperhemispherical lens uses the aplanatic focus of a sphere at a distance $d=r/n$ from the center of the sphere where r is the radius of the sphere. To match the beam from the hyperhemispherical lens to a typical telescope beam ($f/6$ to $f/20$), an additional lens in front of the hyperhemispherical lens is required. The detector, or an impedance matching circuit feeding the detector, receives the full power from the apex of the planar antenna.

The advantages of the planar-structure antennas are their low cost of manufacture, ease of installation, applicability to mass production using photo-lithographic techniques, and lower losses at high frequencies. Earlier work with planar antennas on hyperhemispherical lenses like the bow-tie antenna or logarithmic spiral antenna yielded high receiver sensitivities but suffered from poor coupling to a telescope beam. This effect of poor coupling but high receiver sensitivity stems from the different ways of applying input radiation to the detector. In the case of the coupling efficiency measurements, a single-mode Gaussian beam from the telescope must be coupled to the receiver antenna. Thus the amplitude and phase properties of the receiving antenna's beam are important. For sensitivity measurements, black bodies 105 are used as sources of radiation in front of the receiver, i.e., between the receiver and the telescope. Black bodies are multi-modal sources, and thus all components of the receiver antenna's beam pattern that are not blocked by apertures between the receiver antenna and the outside of the receiver (such as dewar windows, etc.) will receive power from the black bodies. Therefore these measurements are insensitive to the beam pattern quality and the phase of the receiver's antenna. Since the log periodic spiral antenna has superior amplitude beam patterns compared to the bow-tie antenna, a receiver based on the log periodic spiral antenna naturally showed higher sensitivities than one based on the bow-tie antenna. However, both receiver systems showed relatively poor coupling to a single mode Gaussian beam from a telescope when compared to receive systems with waveguide horn antennas. I concluded that this was due to poor beam patterns in phase or amplitude.

Thus, one object of the present invention is to develop an antenna that would allow the receiver to couple to the telescope optics without any such degradation, i.e. antennas with high quality beam patterns. The hybrid antenna of the present invention, as discussed herein, is such an antenna.

Previous measurements of elliptical lens-antennas showed good beam patterns, but the important questions of coupling efficiencies were never addressed. When the extension d (see FIGS. 4*a* and 4*b*) of a hyperhemispherical lens, as compared to a hemispherical lens, is $d=r/n$, with r the radius of the hemisphere and n the refractive index of the dielectric, the lens is aplanatic thus yielding very low losses due to aberrations. However, such a lens has a magnification of $n^2$, which is typically not enough to couple the very broad beam patterns of planar antennas to radio telescopes. A second lens would be required. Instead, the magnification of the hyperhemispherical lens can be increased by moving the planar antenna a distance further than r/n from the center of the hemisphere. At the same time, loss due to aberrations will increase. The important figure of merit is then the coupling efficiency of the system.

Laboratory measurements of the aperture efficiencies and beam patterns of a hybrid antenna as a function of the extension length d of the extended hemispherical lens were performed and it was found that there is an optimum extension length $d_{opt}$ at which the beam patterns are of excellent quality while the coupling efficiency is still nearly as high as for the aberration-free case of the aplanatic lens. This allows good coupling of a hybrid antenna based received to a single mode beam from a radio astronomical telescope, as verified at the Caltech Submillimeter Observatory ("CSO") at 345 and 492 GHz.

The new hybrid antenna of the present invention allows the addition of the properties of excellent radiation patterns and high aperture efficiencies to the advantages of planar antennas. The size of the beam can be designed to match the requirements (e.g. $f/4$ to $f/20$) without any additional optics between the received and the telescope. Furthermore the dielectric antenna is very space efficient, i.e., it has a high aperture efficiency, thus being well suited for heterodyne receiver focal plane array applications.

BRIEF DESCRIPTION OF THE DRAWINGS

These and other aspects of the invention will now be described in detailed with reference to the accompanying drawings, wherein:

FIG. 5 shows the phase fronts for such antenna;

FIG. 6 shows efficiency reduction compared with radius of extended hemispherical lens measured in units of wavelength, graphed for various values of $\epsilon_Y$;

FIG. 7 shows the angular ratios as function of distance from the center of the sphere and can be used for designing this antenna;

FIG. 8 shows a plot of the extension length ratio vs. radius also used for design criteria.

DESCRIPTION OF THE PREFERRED EMBODIMENT

One main inventive concept of the hybrid antenna uses the dielectric substrate lens itself as a radiating antenna by choosing the extension length d of the extended hemispherical lens large enough to just reach its diffraction limited region. The beam launched from that position will approximate a wave with constant phase outside the dielectric antenna. In the limit of very high frequencies and large lens sizes this position would approach that equivalent to the second geometric ray focus of an elliptical lens.

For these conditions it would be advantageous to actually use an elliptical lens rather than an extended hemispherical lens since aberrations will be smaller as discussed below. However, in those cases where the lens size is not much larger than the operating wavelength, an elliptical lens can be approximated with a much lower cost extended hemispherical lens, which was done in all measurements of this work. The extra reduction in efficiency, due to phase errors in the aperture plane, for an extended hemisphere versus a truncated elliptical lens, depends on the diameter of the lens, the wavelength and the refractive index of the lens material. Since different planar antennas will yield different illumination functions, especially at the edges, a constant amplitude in the aperture plane was chosen. This was done to simplify comparison of the different parameters of FIG. 6. A constant amplitude in the aperture plane corresponds to a FWHP beam angle for the planar antenna inside the dielectric of about f/0.5. A quadratic term in the phase front was removed since this reflects only a different focusing position. The ratio of the radius r of the lens to the wavelength $\lambda$ is proportional to the $f$-number of the hybrid antenna, since $$f\text{-number} = \frac{1}{2\tan(\Theta_{FWHP}/2)} \tag{1}$$

with the full width at half power (FWHP) diffraction angle $\Theta_{FWHP}$ given by $$\Theta_{FWHP} \approx \frac{1.2\lambda}{2r} \tag{2}$$

Throughout this specification, definition (1) will be used to describe the $f$-number of an optical system.

Figure 4A:
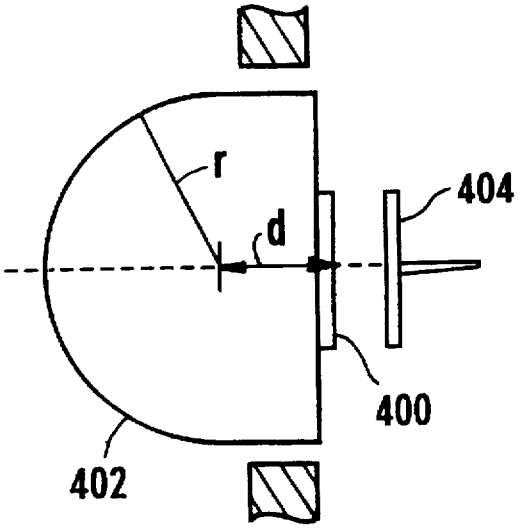
FIGS. 4*a* and 4*b* show detailed layouts of the antenna including the extended hemispherical lens and the feed.
Figure 4B:
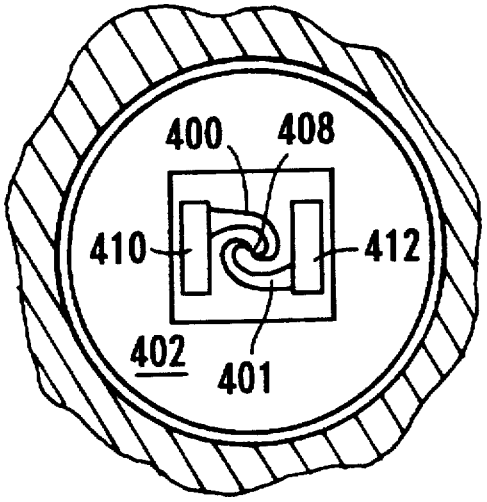

FIGS. 4*a* and 4*b* show a schematic diagram of the hybrid antenna. FIG. 4*a* shows a side view of the antenna, and FIG. 4(*b*) shows a rear view of the antenna. It is easier to conceptualize the operation of this antenna as a transmitter, so the antenna will be explained in this way, first. The antenna includes a detector element 408 which is photolithographed at the central part between the two arms 400 and 401. The detector is, for example, a superconducting detector such as a mixing diode. Intermediate frequency (IF) ports 410 and 412 are connected respectively to the detector through antenna arms 400 and 401.

Assuming a transmitter, the detector in the center generates the power which travels on the arms. The power will be radiated away from these arms within about a wavelength. Therefore, by making the arms longer than one wavelength, the power never reaches the IF ports. This makes the antenna frequency independent, because all power will be radiated away from the antenna before it reaches the end and thus the effective aperture scales with wavelength.

In actuality, however, the antenna is intended for receiving. The detector down-converts from a high frequency to a much lower intermediate frequency (IF) and radiates the down-converted information outward on the arms to the IF ports. At the down-converted frequency, the arms act as wires, not radiators. The IF ports form the electrodes from which the down converted information will be received.

Conceptually speaking, the hybrid antenna acts like a parabolic dish. A parabolic dish receives information on the parabola, and focuses it to the feed. The beam characteristics depend mostly on the parabola.

In the present invention, the focusing occurs to the planar feed antenna, i.e. on to the arms of the spiral antenna which receive this information. The high frequency information is then propagated by the arms to the detector. Simultaneously, the intermediate frequency information travels in the opposite direction, towards the IF ports.

Continuing the analogy above, the present invention uses a hemispherical dielectric lens 402 instead of the parabola. This lens acts just like a lens in an optical system. Dielectric lenses have been used for this purpose before—and they can change the broad beam width (e.g. f/0.5 into an f/1 or a f/2 beam). The latter beams however are still very broad. Like any lens, however, there is a theoretical limit to the amount of focusing it can do.

The inventor of the present invention exploited this theoretical limit, by designing a lens which essentially "asks" the lens to transform the beam beyond what the lens can theoretically do. For example, a design was made asking the lens to output a beam which is as thin as a laser beam. No lens, however, can transform a beam to be narrower than its diffraction limit. The lens does the best that it can, but when asked to do more, it radiates the information at its diffraction limit.

By designing the lens in this way, the lens has been turned into a radiating aperture.

Past workers believe that if a lens is "pushed" too hard, it will have bad aberrations and will be unusable. I first found that such a design parameter could still be usable.

The design of the lens will be discussed in more detail herein. However, a summary will first be made with reference to FIG. 7. FIG. 7 shows the angular ratio as a function of distance from center of sphere. In the region to the left of, for example, 3 mm, the lens is operating as a real lens. The chain and dotted lines show the diffraction limits. This feature is used to transform the dielectric lens into a radiating element.

The above summary will be elucidated in more detail herein.

Planar antennas suffer from power loss to substrate modes when the dielectric substrate is of comparable thickness to a wavelength. The present antenna mounts the planar feed antenna on a substrate lens antenna and eliminates this problem by simulating a semi-infinite half-space of the dielectric for the planar feed antenna. This also biases the feed antenna to radiate preferentially in the direction of the dielectric.

A spiral feed planar antenna 400, shown in FIG. 4b, is preferably used according to the present invention. For a dielectric constant of $\epsilon_r$=3.8 and a spiral feed antenna, the ratio of power radiated into the dielectric to that radiated to the opposite face was found to be about 7 dB. This ratio depends on the beam width of the planar antenna and will increase for wider beams and higher dielectric constants $\epsilon_r$. The spiral antenna used throughout is a two-turn, self-Babinet-complimentary structure, with a diameter of about 3 mm. A metal back plane 404 on the free side of the feed antenna is used to reflect forward that power which would otherwise be lost from the beam. The back reflector does not impact the beam patterns but acts only to recover the power otherwise lost. The back reflector is positioned for peak response at about ⅜λ away from the planar feed antenna. The back reflector, however, can be eliminated by using a dielectric substrate of high dielectric constant, such as high resistivity silicon ($\epsilon_r$=11.7), since the power radiated into the free space direction is then negligible. However, the transition from the front surface of the dielectric lens-antenna to free space is then more critical, requiring the use of an anti-reflection coating.

The dielectric lens-antenna is an elliptical lens, approximated by an extended hemisphere. An elliptical lens has infinite angular magnification for geometric ray optics when the antenna is at the second focus, whereas a hemispherical lens, i.e., an extended hemispherical lens with extension d=0, has an angular magnification of unity. The angular magnification thus increases roughly from unity to infinity as d is increased from zero to the distance where the extended hemisphere approximates an elliptical lens.

However, for radiation of a wavelength comparable to the radius of the lens, geometric ray optics alone no longer forms a good approximation. There, the system must take into account the diffraction limit of the lens, which is governed by the radius of the lens. It is then not necessary and as shown below, not advisable to increase d beyond a position called $d_{opt}$ where every ray launched by the feed antenna is either already within the diffraction limit (as given by (3)) of the beam leaving the hybrid antenna or is refracted into it by the extended hemispherical lens, as shown in FIG. 7. FIG. 8 shows a plot of the ratio $d_{opt}/\tau$ versus the radius of the lens r measured in units of wavelength.

EXAMPLE 1

Measurements of beam patterns as a function of the extension d of the hemispherical lens were performed at 115 GHz and 492 GHz. The extension d was increased in the measurements by adding quartz slabs of 0.254 mm thickness between the flat surface of the dielectric lens and the substrate of the planar antenna. The radius r of the dielectric lens antenna used in the 115 to 492 GHz measurements was r=6.35 mm and the refractive index n=1.95 of the fused quartz dielectric. The same parameters were used to generate FIG. 7. The quality of the patterns increases when the distance d is increased from the hemispherical case of d=0 up to the point $d_{opt}$ where the beam is diffraction limited and the sidelobes are at a minimum. The position $d_{opt}$ is slightly different for different frequencies as can be seen in FIGS. 7 and 8. When the wavelength of the radiation is decreased, the amount of angular magnification necessary to refract all rays within the diffraction limit must increase (and thus d) since the diffraction angle $\Theta_{FWHP}$ is given by equation (3), i.e. depends on the wavelength λ. FIG. 9 also shows the experimentally determined optimum position at 115 GHz (λ=2.6 mm), $d_{opt}^{meas.}$ (115 GHz)=4.27±0.2 mm. Beam pattern measurements done at 492 (λ=0.61 mm) as a function of d yielded $d_{opt}^{meas.}$ (492 GHz)=5.4±0.2 mm. Both measured positions agree very well with the predicted positions from FIGS. 7 and 8, $d_{opt}^{pred.}$ (115 GHz)=4.33 mm $d_{opt}^{pred}$ (492)=5.34 mm and $d_{opt}(f_h)$ as determined for the highest frequency $f_h$. As shown later (see table 3) the aperture efficiency at the lowest frequency $f_l$ will then be slightly lower than the optimum attainable for that frequency, since $d_{opt}(f_h)>d_{opt}(f_l)$. However, unless the operating range is more than an octave, the reduction in aperture efficiency is typically less than about 10%.

TABLE 1

Beam pattern measurements summary

| diam. mm | Freq. [Ghz] | FWHP (E) | FWHP (H) | f # | f # · λ [mm] |
|---|---|---|---|---|---|
| 6.35 | 115 | 20.3 | 17.8 | 3.0 | 7.8 |
| 6.35 | 208 | 11.6 | 11.3 | 5.0 | 7.2 |
| 6.35 | 492 | 4.86 | 5.39 | 11.2 | 6.8 |
| 12.7 | 115 | 10.9 | 10.2 | 5.4 | 14.1 |
| 12.7 | 208 | 5.4 | 6.3 | 9.8 | 14.2 |
| 12.7 | 214 | 4.9 | 6.1 | 10.4 | 14.6 |
| 12.7 | 321 | 4.0 | 4.1 | 14.2 | 13.3 |
| 12.7 | 428 | 2.85 | 2.91 | 19.9 | 13.9 |
| 12.7 | 492 | 2.92 | 2.52 | 21.1 | 12.8 |

Table 1 summarizes beam pattern measurements performed between 115 GHz and 492 GHz with dielectric antennas of two different diameters: 6.35 mm and 12.7 mm. The beam size is given as the full width at half power (FWHP) in the E- and H-plane of the transmitting horn antennas. The f# is calculated from the geometric FWHP angle $\Theta_{FWHP}$ via equations (2) and (3). The product, f#·λ, yields the spot size in the image plane and should correspond to the diameter of the dielectric lens-antenna, if the antenna behaves as a diffraction limited, uniformly illuminated aperture. As shown in Table 1, this is approximately the case for all the measurements. However, Table 1 shows a general trend for f#·λ to decrease with frequency. This is attributed to an increase in the measured beam width due to phase errors. There are two sources of phase error: First, as shown in FIGS. 5 and 6, there are phase errors from aberrations and second, there are phase errors from surface inaccuracies of the lens. The lenses with a diameter of 6.35 mm and 12.7 mm have a surface accuracy of better than 2 μm. The loss of coupling efficiency L can be estimated from the following formula, modified for a lens with refractive index n:

$$L=1\ e^{-(2\pi(n-1)E_{RMS}/\lambda)^2}, \quad (3)$$

which is negligible at submillimeters wavelengths for the lenses used.

Numerical calculations solving Maxwell's equations inside and outside the dielectric antenna show the validity of using geometric ray optics combined with the diffraction limit to understand the hybrid antenna. These results will be discussed elsewhere.

A very important aspect of an antenna is that it couples power efficiently to the mode provided by the rest of the optical system, typically a single mode Gaussian beam from a telescope. Laboratory measurements at 115 GHz with a planar-logarithmic-spiral-structure as the feed antenna of a hybrid antenna were performed and an aperture efficiency of 76% was obtained. These measurements were performed at room temperature with a bismuth bolometer at the apex of the planar feed antenna. The manufacture of the bismuth bolometers and their responsivity calibration have been well described by in the act. The measured aperture efficiency depends on absolute power measurements done with the bolometer, which was thermally calibrated with direct currents provided through the bias circuit.

EXAMPLE 2

For the RF measurements the extended hemisphere was covered with a quarter-wave anti-reflection coating to avoid reflection from the dielectric surface, and the back reflector was positioned for maximum response. In the design presented here, the hybrid antenna is fed by a planar logarithmic spiral antenna, which accepts elliptical polarization. The polarization of the hybrid antenna is therefore elliptical too. The transmitter used a standard gain horn with linear polarization. Two measurements with the transmitter horn rotated by 90° were performed and the received power for the two perpendicular linear polarizations of the transmitter measurements was less than 10% showing that the hybrid antenna with a logarithmic spiral antenna is nearly circularly polarized, i.e. the eccentricity of the elliptical polarization is small. By adding the power of the two polarization measurements together the hybrid antenna's circular co-polarized component is added to the circular cross-polarized component. In millimeter and submillimeter wavelengths radio astronomy the signal is typically randomly polarized so that the addition correctly represents the received power.

No correction was made for any mismatch between the antenna impedance and the bolometer, since the resistance of the feed antenna's arm material was not well known and the bolometer's resistance could not be measured without the feed antenna in series. The thickness of the antenna arms was approximately 0.2 nm (nano meters) and RF losses due to the surface resistance of the antenna arms were also not taken into account. The actual efficiency will therefore be higher than quoted here. However, these effects are estimated to be less than 5%. Subsequent to the measurements discussed here, efficiency and beam pattern measurements using planar Schottky diodes soldered into the apex of a logarithmic periodic antenna at 90 GHz and 180 GHz and with a double slot antenna at 246 GHz were performed. They confirmed the measurements of this work with higher signal to noise levels for the pattern measurements and calculated similar aperture efficiencies from the pattern measurements.

In general, the aperture efficiency is defined by the ratio of the effective aperture $A_e$ and the physical aperture $A_p$ $$\eta_{ap} = \frac{A_e}{A_p} \quad (4)$$

Note that the effective aperture includes all losses from dissipated, reflected and scattered power. The physical aperture of the hybrid antenna with a lens radius of r=6.35 mm is $A_p=\pi r^2=127\ mm^2$. Friis' transmission formula yields the effective aperture of the hybrid antenna $$Ae = \frac{P_r l^2 \lambda^2}{P_t A_{et}} \quad (5)$$

with $P_r$ the power received by the bolometer, $P_t$ the power into the transmitting antenna, l the distance between the transmitting antenna and the receiving hybrid antenna, and $A_{et}$ the effective aperture of the transmitting antenna. The effective area of the transmitting antenna, a standard gain horn (Alpha Ind. model F861-33), was calculated and also measured in a symmetric setup using two identical standard gain horns. The received and transmitted power was measured with an Anritsu power meter (model ML83A with power head MP82B1) and Friis' transmission formula (5) solved for the effective aperture of the standard gain horn. This assumption that the horns were identical was verified using a third horn by replacing the two identical horns with each other. The effective area of the horn was found to be $A_e(horn)=(142\pm9)\ mm^2$. The effective area of the hybrid antenna is $$\text{is } A_e(hybrid)=(95\pm7)\ mm^2 \quad (6)$$

and thus for the aperture efficiency $$\eta=0.76\pm0.06. \quad (7)$$

The error in the measurement is mostly due to the uncertainty in the measurement of the effective area of the horn antenna (1σ: 6%) and the absolute power calibration of the bolometer (1σ: 5%).

For applications requiring only one polarization, the cross polarized power would have to be subtracted, reducing the aperture efficiency by that fraction. Using a linear polarized planar logarithmic periodic antenna as the feed antenna for the hybrid antenna, a maximum cross-polarized beam of −7 db relative to the co-polarized beam was found. The cross-polarized beam pattern followed the co-polarized pattern so that it only reduces the aperture efficiency for applications with a singly polarized source. Also note that all measurements were made in a realistic environment for the hybrid antenna, i.e. in a metal mixer block rather than idealized conditions. If linear polarization is a requirement for a particular application but multi-octave bandwidth can be sacrificed, recent work by Zmuidzinas and LeDuc with a double slot antenna suggests that this planar antenna may be a good choice as a feed antenna for a hybrid antenna.

EXAMPLE 3

Application of a single hybrid antenna in an SIS receiver A single hybrid antenna was successfully tested at the Caltech Submillimeter Observatory (CSO), a 10.4 m diameter submillimeter telescope on Mauna Kea, Hi., in an application with a superconducting insulator superconductor (SIS) detector in heterodyne mode and an RF matching circuit integrated on the arms of a planar logarithmic spiral feed antenna. Aperture, main beam and forward efficiencies of the radio telescope with a hybrid antenna based receiver and scalar-feed horn waveguide receiver systems were measured at 345 GHz and 492 GHz. When the respective efficiencies were compared between the hybrid antenna based received and a waveguide horn based receiver, they were found to be identical within the measurement uncertainties (1σ: 10%). These efficiencies include the coupling efficiency between the telescope and the receiver, besides other factors that are constant at each frequency when one receiver is replaced with another one. In conclusion, the coupling of the hybrid antenna based receiver to a single mode Gaussian beam from a telescope is thus about the same as that of a scalar-feed horn waveguide receiver. This is the first quasi-optical receiver tested on a radio astronomical telescope to achieve such good performance. Measurements using the hybrid antenna based receiver in accordance with the present invention have shown a double sideband spectrum taken in the core of the Orion molecular cloud (OMC-1) with the two sidebands centered at 492.16 GHz and 494.96 GHz. Note that the good coupling between the hybrid antenna and the telescope optics is due to the high quality beam patterns of the hybrid antenna and is not necessarily a statement about the intrinsic efficiency of the hybrid antenna itself. The hybrid antenna's coupling efficiency affects the sensitivity of the receiver. Table 2 shows the sensitivities obtained with the receiver system, expressed as double sideband noise temperatures. The sensitivities obtained are very high and approach those of the best waveguide receivers. The increase of noise temperature at 492 GHz is due to the fact that the lithographic matching circuit, which is designed to tune out the SIS junction capacitance, rolls off at about 475 GHz.

TABLE 2

Receiver noise temperatures.

| Frequency [GHz] | 318 | 395 | 426 | 492 |
|---|---|---|---|---|
| $T_{Rx}$ (DSB) [K] | 200 | 230 | 220 | 500 |

The very high sensitivities obtained with the receiver are an indication that the intrinsic coupling efficiency of the hybrid antenna is high. However, it was not possible, as is usually the case, to quantify the coupling efficiency of the hybrid antenna from the noise temperature measurements. The coupling efficiency is just one of many parameters that determine the receivers sensitivity, most of which are not easily measured to better than 10%.

EXAMPLE 4

An antenna that is to be used as an element in a heterodyne array receiver must have several features in addition to being a good single element. Its aperture efficiency has to be high to efficiently sample the image plane, the beam width should be narrow and preferably matched to the telescope optics without further optics, and finally, the cost and ease of manufacture has to be reasonable if large arrays are anticipated.

Table 3 shows that the aperture efficiency peaks at the optimum extension length $d_{opt}$ as determined experimentally (FIG. 9) and theoretically (FIGS. 7 and 8). The lower aperture efficiency, for extension lengths d smaller than $d_{opt}$ are due to the increase in beam size, whereas the coupling efficiency is expected to increase towards the aplanatic case (d=r/n=3.25 mm), due to smaller aberrations. Absolute measurements of the Gaussian coupling efficiencies were not performed. However, Gaussian coupling efficiencies are experimentally found to be lower for the aplanatic case and highest close to the hybrid antenna case. This is consistent with measurements by Filipovic et al.

EXAMPLE 5

The hybrid antenna in a fly's-eye configuration is considered a good candidate for a single element of an array. Hybrid antennas have high aperture efficiencies and diffraction limited beams, thus allowing sampling at half the Nyquist rate of the image plane. Planar antennas, which are the feed antennas for hybrid antennas, are inexpensive and easy to manufacture lithographically.

The extended hemispherical or elliptical lenses can be manufactured from a mold since the surface accuracy requirements in the millimeter and submillimeter wavelength ranges do not require optical quality finish. To keep the power loss due to surface inaccuracies below 1%, the RMS surface error as determined from (4) has to be better than $\lambda/20\pi(n-1)$, which is about 10 μm at 500 GHz for a quartz lens.

It is important to note that if the receiver is operated in a total power mode, the image plane has to be sampled at twice the rate (for each linear dimension) compared to a mode where the electric field with its phase is measured. Radio astronomical receivers used for single telescope observations are typically operated in a total power mode (e.g. autocorrelator spectrometers produce power spectra), despite the fact that, in principle, they are heterodyne receivers and measure amplitude and phase, i.e. they are field sensitive. The image plane of a given optical system contains Fourier components of the electric field up to a cutoff frequency $f_c^E$, which determines the maximum spatial resolution of the source obtainable with the particular optical system. For power measurements there are Fourier components up to twice the cutoff frequency for the electric field components due to squaring of the fields, i.e. $f_c=f_c^P=2f_c^E$ Nyquist sampling then requires twice the spatial cutoff frequency $f^P$. This implies that a two dimensional array receiver in power detection mode requires four times as many detectors as one that preserves the electric field with the phase information until the image is reconstructed.

The size of the receiving antenna could be made half the linear size of the diffraction limit for field detection or one-quarter the linear size for power detection to allow for Nyquist sampling, as is often done for optical systems that

TABLE 3

Aperture efficiencies ηA for different lens extension length d measured at 115 GHz.

| Extension | 3.25 | 3.51 | 3.76 | 4.01 | 4.27 | 4.52 | 4.67 | 5.18 |
|---|---|---|---|---|---|---|---|---|
| Mean FWHP [°] | 24 ± 3 | 17.2 ± 1.7 | 10.8 ± 0.5 | 11.2 ± 0.5 | 10.5 ± 0.5 | 10.2 ± 0.5 | 10.5 ± 0.5 | 10.0 ± 0.5 |
| ηA [%] | 18 ± 2 | 29 ± 3 | 58 ± 7 | 65 ± 7 | 76 ± 6 | 67 ± 7 | 66 ± 6 | 71 ± 7 |

are background noise limited. However, in broadband (IF) millimeter and submillimeter wavelength heterodyne receivers, the detector's sensitivity typically determines the overall system sensitivity. Reducing the size of the antenna would reduce the amount of power received by it. Since the noise power produced by the detector stays constant, the signal to noise ratio will suffer. The quadratic relation between the integration time required to achieve a certain signal to noise ratio and the system's sensitivity thus rules out this approach as long as the system's sensitivity remains detector limited.

In this paragraph the reason for suggesting the fly's-eye configuration over a single lens system will be discussed. Measurements of individual planar feed antennas on one big hyperhemispherical lens showed poor beam patterns for the off-axis elements. A lens with 4λ diameter showed significant distortions of the main beam when operated ¼λ off axis and sidelobe levels as high as −4 dB were present when operated ½λ off axis. Measurements of an array of feed antennas on an extended hemispherical or elliptical lens, i.e. as a hybrid antenna with an array of feed antennas, were not performed, since the required size of the lens to accommodate an array with low distortions would produce beams too narrow to match directly to typical f-numbers of a telescope. However, for arrays with very few elements, feeding telescopes with relatively high f-numbers, this would be a possible configuration worth investigating. In my opinion, the fly's-eye technique is more versatile since it does not restrict the number of elements in the array (the feed antennas are usually fairly big due to the IF and DC connection pads), allowing for the size of the beam to be designed to directly match the beam from a telescope, and allowing all elements of the array to perform equally. Systems that do not provide for a direct match to the telescope optics may suffer from losses introduced from the additional optics required to match the beams. The hybrid antenna in the fly's-eye configuration avoids these problems. Additionally, the size of the feed antenna is much smaller than the size of the hybrid antenna, thus easily providing room for IF connections or circuits at each element of an array.

II. BEAM PATTERN AND EFFICIENCY MEASUREMENTS

Two issues, those of quality of beam patterns and coupling efficiency of the antenna, must be addressed for an antenna in a quasi-optical receiver that couples to an outside optical system. For an array receiver, the aperture efficiency of the individual antennas is important too, since it is a measure of the efficiency in the use of focal plane space with which the antennas sample the incoming radiation. In general, these properties are, of course, related. However, for simplicity they will be treated separately and, as an example, an application of a hybrid antenna for a radio astronomy receiver will be discussed.

Beam pattern measurements can usually be performed rather easily whereas efficiency measurements require absolute power calibration. The latter can be difficult at millimeter and submillimeter wavelengths. The beam pattern measurements will be discussed first.

a) Beam pattern measurements

The beam pattern measurements were performed using a computer controlled full two-dimensional angular far-field scanning antenna range in a microwave absorbing chamber. The source for the 115 GHz measurement was a Gunn oscillator, and for frequencies up to 500 GHz Gunn oscillators followed by multipliers were used. The measurement at 584 GHz used a far infrared laser system for the source. The distance between the source and the hybrid antenna was about 1 meter. The sources were all linearly polarized and modulated with a chopper wheel. The detector for the power received by the antenna was a bismuth bolometer placed at the apex of the planar antenna. The bolometer was DC-biased and the chopped signal amplified with a lock-in amplifier. The dynamic range of the set-up was about 25 dB. To get better dynamic range than the one achieved here with room temperature techniques would require the use of different detectors such as Schottky diodes. However, bolometers were chosen since they could be manufactured lithographically in situ with the antenna structure rather than having to mount a separate detector in the apex of the antenna. The size of the bolometers is about 1 μm, enabling the antenna measurements to be performed in the submillimeter band without having the size of the detector affect the characteristics of the antenna system.

Figure 1A:
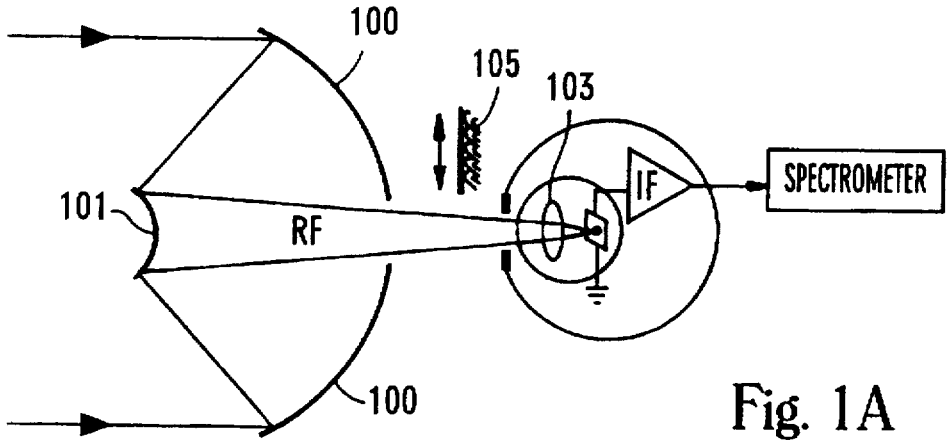
FIG. 1 shows a radio telescope system.
Figure 1B:
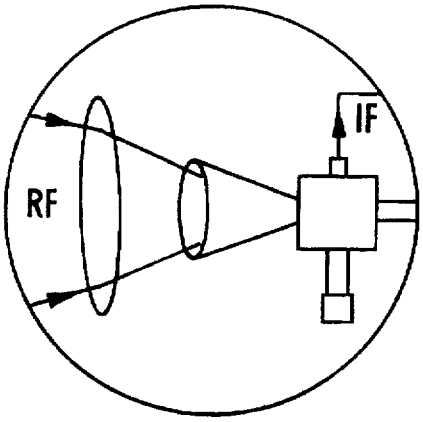
Figure 1C:
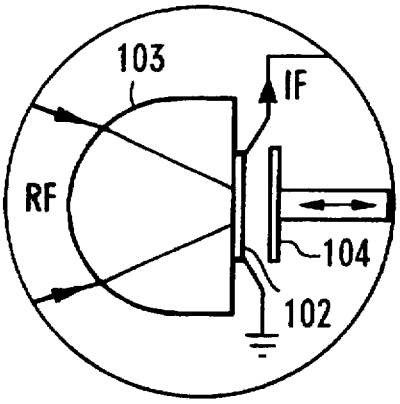
Figure 2A:
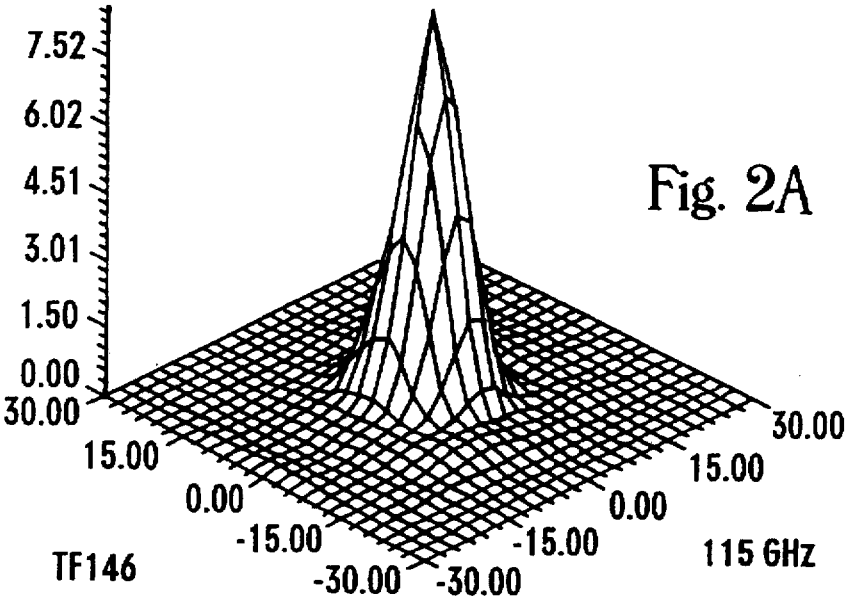
FIG. 2*a* shows a linear scale depiction of the hybrid antenna's beam pattern.
Figure 2B:
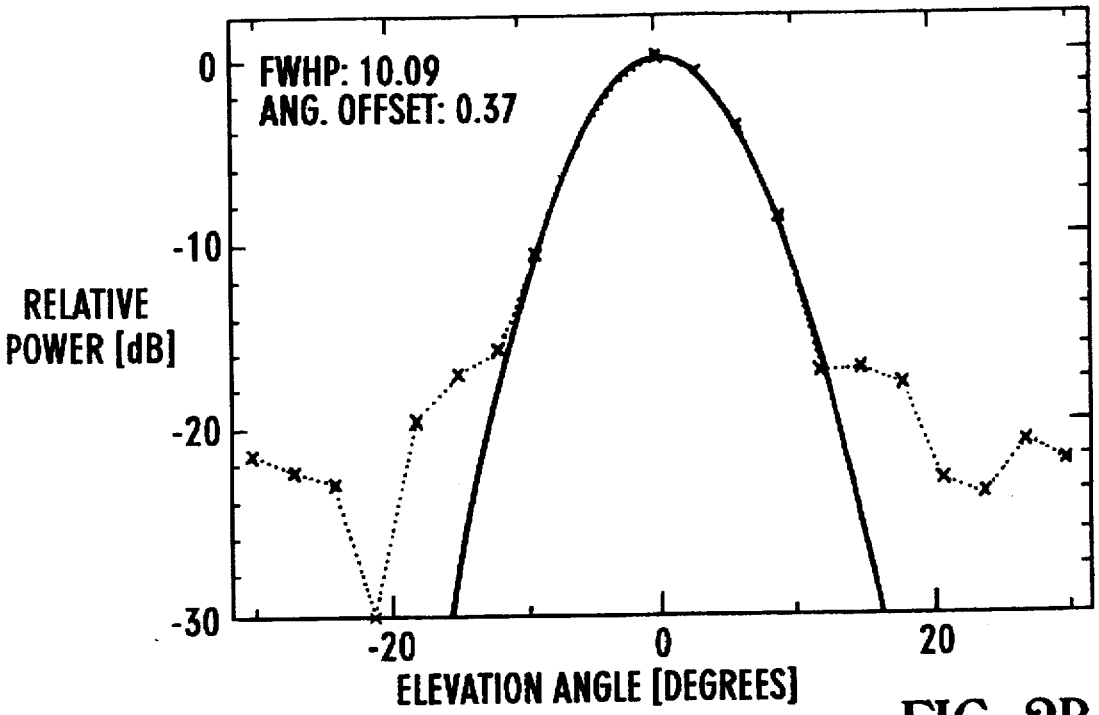
FIGS. 2*b* and 2*c* show perpendicular cuts in Logarithmic scale depiction.
Figure 2C:
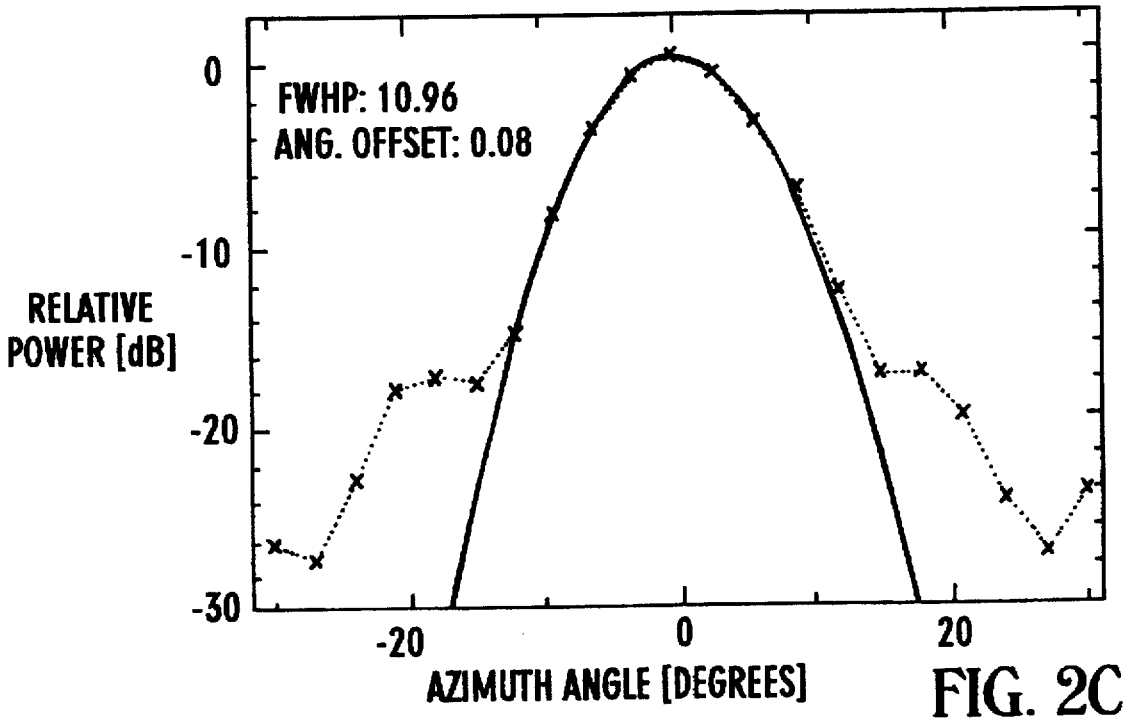
Figure 3A:
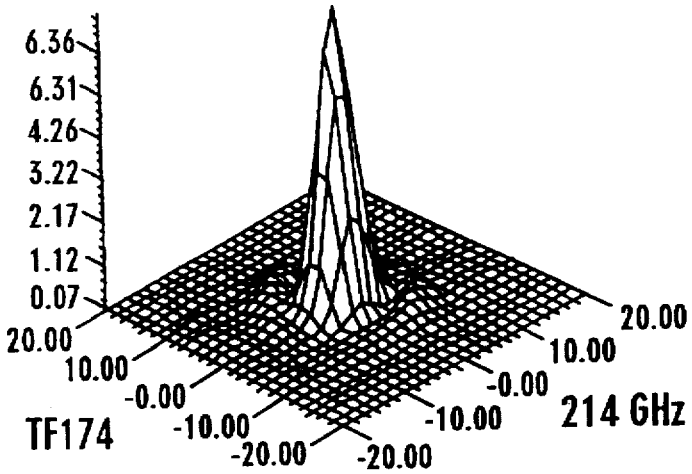
FIG. 3 shows beam pattern measurements at various frequencies.
Figure 3B:
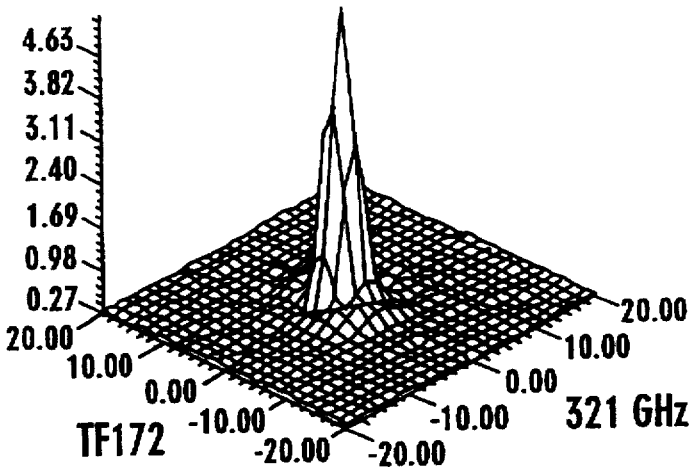
Figure 3C:
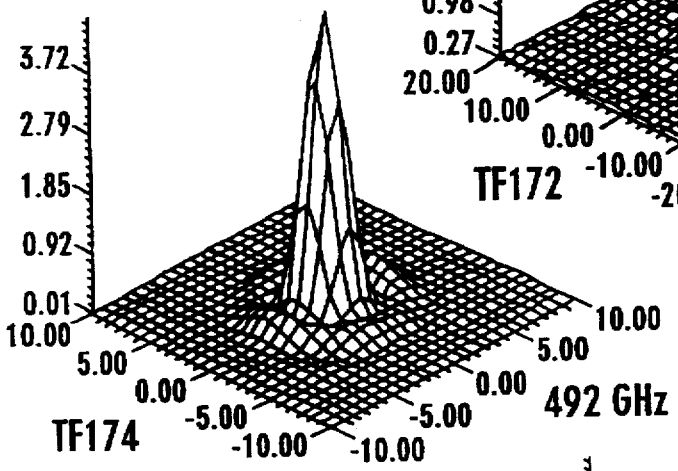
Figure 3D:
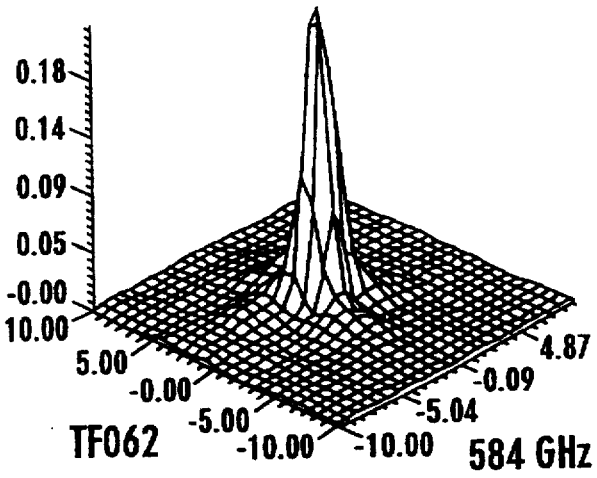

FIG. 2*a* shows the excellent beam pattern quality of a hybrid antenna in a three-dimensional linear scale depiction. FIGS. 2*b* and 2*c* show two perpendicular cuts in a logarithmic scale depiction.

FIG. 5 shows the phase fronts as calculated with geometric ray optics for a 12.7 mm diameter lens with a refractive index of n=1.95 at 500 GHz. The reduction in efficiency is calculated from the phase error σ(σ,φ) by $$P_{loss}^{phase} = \langle e^{i\sigma} \rangle^2 = 1 - \frac{\left| \int_0^{2\pi} \int_0^{r} e^{i\sigma}(\rho,\phi) p\,dp\,d\Phi \right|^2}{\left[ \int_0^{2\pi} \int_0^{r} p\,dp\,d\Phi \right]^2} \tag{8}$$

and is about 10%. The electric field is assumed to be constant in amplitude across the aperture. The onset of sidelobe shoulders at about −17 dB, as shown in FIG. 2*b* and 2*c*, is a typical signature of an Airy pattern from the constant illumination in phase and amplitude of the circular aperture and are consistent with the above assumption. However, it is important to stress that there can be very different illumination functions that will still produce beams with sidelobes at −17 dB. Most of the phase errors occur at the edges of the aperture as can be seen in FIG. 5.

The operating principle of a hybrid antenna was discussed above. The pattern was taken at 115 GHz with a 12.7 mm diameter fused quartz lens of dielectric constant $\epsilon_r$=3.8 with the hybrid antenna mounted in a metal mixer block like the one used in the SIS receiver with a back reflector, as described later. The measurements were performed in a metal mixer block, as encountered in most applications, so as not to exclude the possibility of problems arising from the proximity of conducting surfaces to the hybrid antenna. The metal of the mixer block in the configuration used is concentric around the hybrid antenna in the same plane as the planar antenna with a distance from the apex of the planar antenna equal to the radius of the extended hemisphere (see FIG. 4). FIG. 3 shows beam pattern measurements at 214, 321, 492 and 584 GHz. The 214 and 321 Ghz measurements used low efficiency multipliers to generate the transmitter signal, thus the lower signal to noise levels. The 492 GHz measurements used a high efficiency Gunn multiplier chain yielding signal to noise ratios as good as in the 115 GHz measurements.

Although only a few embodiments have been described in detail above, those having ordinary skill in the art will certainly understand that many modifications are possible in the preferred embodiment without departing from the teachings thereof.

All such modifications are intended to be encompassed within the following claims.

III. Conclusions

Beam pattern and aperture efficiency measurements of hybrid antennas were performed and hybrid antennas are ground to be good candidates for focal plane imaging array receivers. Their manufacture is low cost and allows for mass production in arrays. Due to the hybrid antennas' diffraction limited performance they will allow sampling at half the Nyquist rate of the image place for field detection or half that sampling for power detection. Depending on the application, the feed antenna can be chosen to be a broad band antenna (several octaves) like logarithmic spiral antennas with circular polarization, or a logarithmic periodic antenna with linear polarization. The f-number of the beam can be custom designed to match the optics of a telescope directly. The feed antenna is smaller than the hybrid antenna itself thus ample room for IF connections or circuitry is available at each array element.

Using a planar logarithmic spiral antenna for the feed of the hybrid antenna, an aperture efficiency of 76% was measured. The hybrid antenna was tested in an SIS receiver with a Nb/$AlO_x$/Nb tunnel junction and a broad band matching circuit yielding coupling efficiencies to a telescope as high as those obtained with corrugated feed horn based receiver systems and sensitivities approaching those of the best waveguide receivers for submillimeter wavelengths.

What is claimed is:

1. A hybrid antenna system, comprising:

a dielectric lens; and a planar antenna adjacent to said dielectric lens, wherein said dielectric lens is formed of an extension length D large enough to just reach its diffraction-limited region and to transform said dielectric lens into a radiating antenna.

2. The system as in claim 1 wherein said dielectric lens is an extended elliptical lens.

3. The system as in claim 1 wherein said dielectric lens is an extended hemispherical lens.

4. The system as in claim 1 wherein said antenna is a log spiral antenna.

5. A method of forming a hybrid antenna system, comprising the steps of:

determining a theoretical limit of focus of a dielectric lens;

shaping and locating said dielectric lens beyond the theoretical limit of what the dielectric lens can focus, such that the dielectric lens does not focus input beams but instead radiates the input beams at its diffraction limit to effectively perform as an aperture radiating element; and forming a planar antenna part adjacent said dielectric lens in a location to receive radiation from the dielectric lens.

6. A hybrid antenna system, comprising:

a dielectric lens, having a diffraction limit, shaped and positioned such that every beam impinging thereon is outside the diffraction limit thereof and beyond the theoretical limit of what the dielectric lens can focus, such that the dielectric lens radiates, rather than focusing, information corresponding to the beam; and a planar log-spiral antenna part, including two spiral arms, and a detector in a central portion thereof, said planar log-spiral antenna part located adjacent said dielectric lens and receiving radiation radiated by said dielectric lens;

wherein said planar log-spiral antenna includes two IF ports, respectively at ends of said arms of said planar log-spiral antenna.

7. An antenna as in claim 6 wherein said antenna is a transmitter, the detector generates power travelling on the arms which is radiated away from the arms within a wavelength, and wherein the arms have a length longer than one wavelength such that said power does not reach the IF ports.

8. An antenna as in claim 6 wherein said antenna is a receiver, said dielectric lens radiating information to said detector which down-converts a first frequency of the information to a second frequency at which the arms act like wires instead of radiators, the information being transmitted over said wires at said second frequency to said IF ports, from which the information is received.

9. A hybrid antenna system, comprising:

a dielectric lens; and a planar antenna adjacent to said dielectric lens, wherein said planar antenna is a log-spiral antenna with arms and which includes two IF ports at ends of said arms of said planar log-spiral antenna;

wherein said dielectric lens is formed of an extension length D large enough to just reach its diffraction-limited region and to transform said dielectric lens into a radiating antenna.

10. An antenna as in claim 9 wherein said antenna is a receiver, said dielectric lens radiating information to said detector which down-converts a first frequency of the information to a second frequency at which the arms act like wires instead of radiators, the information being transmitted over said wires at said second frequency to said IF ports from which the information is received.

* * * * *